US005456060A

United States Patent [19]

Tipp

[11] Patent Number: 5,456,060

[45] Date of Patent: Oct. 10, 1995

[54] SYSTEM FOR SLITTING AND OPENING COIN ROLLS

[76] Inventor: Raymond P. Tipp, P.O. Box 3778, Missoula, Mont. 59806

[21] Appl. No.: 122,069

[22] Filed: Sep. 17, 1993

[51] Int. Cl.[6] ..... B65B 43/26

[52] U.S. Cl. ..... 53/492; 30/450; 53/381.2

[58] Field of Search ..... 30/2, 429, 430, 30/431, 450; 53/381.1, 381.2, 492

[56] References Cited

U.S. PATENT DOCUMENTS

| | | | |
|---|---|---|---|
| 2,090,085 | 8/1937 | Wegner | 30/450 |
| 2,599,551 | 6/1952 | Hagen | 30/450 |
| 3,100,057 | 8/1963 | Tanuma | 30/450 |
| 3,153,851 | 10/1964 | Tanuma | 30/450 |
| 4,680,850 | 7/1987 | Boucherie | 53/381.2 |
| 4,835,860 | 6/1989 | Infeld | 30/450 |

FOREIGN PATENT DOCUMENTS

| | | | |
|---|---|---|---|
| 1124426 | 10/1956 | France | 53/492 |

*Primary Examiner*—W. Donald Bray
*Attorney, Agent, or Firm*—Harry M. Cross, Jr.

[57] ABSTRACT

The coin roll slitting device of this invention comprises a main body section of a size that is convenient to be grasped by a user's thumb and fingers, an arm section extended outward from said body section and provided with a downwardly extending end protrusion, and a slitting blade provided with an exposed sharpened cutting edge, The slitting blade being mounted by the body section in a way such that its sharpened cutting edge is inclined forwardly and upwardly to end at a tip that underlies the arm section. The arm section extends forwardly away from the body section a sufficient distance that its end protrusion is located forwardly of said blade tip. There is a space between the blade tip and the underside of the arm section that is sufficient to enable a rolled or crimped rim of a coin roll to be inserted in said space to bring the blade up against an exposed face of an end coin in the coin roll.

8 Claims, 1 Drawing Sheet

SYSTEM FOR SLITTING AND OPENING COIN ROLLS

FIELD OF THE INVENTION

This invention relates to devices for opening the wrapping paper enclosing a roll of coins and, more particularly, to coin roll slitting devices.

BACKGROUND OF THE INVENTION

Coins, such as dimes, nickels, quarters, etc., are enclosed in a wrapping paper in roll form for ease of handling and storing. These coin roll wrappings are tubular and open at both ends. When coins are inserted in a coin roll wrapping, the roll ends are crimped against the exposed coins to securely hold the coins within the wrapping. In the crimping process, the tubular ends of the wrapping are rolled radially inward to provide an annular rim at each end of the coin roll. Each annular rim bears tightly against an exposed coin face and so the roll of coins are tightly compacted together in face-to-face relationship.

The wrapping paper used for coin roll wrapping is tough and not easily torn. Consequently, when the tubular ends of the wrapping paper are crimped and rolled into annular rings, they are not easily undone to expose the coins for removal from the coin roll. Establishments that use several coin rolls in their business dealings are especially troubled by the difficulty in opening coin rolls. Generally speaking, the common mode of opening a coin roll is to smash the coin roll against a sharp corner, such as the edge of a cash register change tray or the edge of a counter. When the mid section of a coin roll is smashed against a sharp edge with enough force, the coin roll will split open at its mid section and the coins will spill out at random. Unfortunately, if too much force is used to smash a coin roll open, the coins will fly out and spill away, causing a turmoil as the person opening the coin roll scrambles to retrieve the loose coins.

Furthermore, when the coin roll is thus opened, it is useless for continuing to hold coins. If only a few coins are desired to be removed, the smashed coin roll cannot continue to be used as a coin repository. If for example, a roll of coins is used as a source of coins for placement in a parking meter, a situation where only a few coins would be removed from the coin roll at a time, the technique of opening a coin roll by smashing is simply not suitable. Therefore, the person desiring to remove only a few coins from a coin roll and leave the remaining coins in the wrapped roll, must deal with the hard-to-open annular rolled rims at the end of the coin roll. It is very difficult, especially for women, to dig or pry a rolled rim open with ones fingers or finger nails; it is even difficult to pry a rolled rim open with the end of a key.

Some coin roll wrappings are spirally-wrapped tubes and for these, oftentimes, the only convenient way to open them is to peel an external portion of the spiral wrapping loose and tear it away. As the torn loose paper is unwrapped, one will eventually remove the end of the coin roll wrapping thereby exposing several of the coins at the opened end. The torn-opened end of the coin roll is untidy and not conducive to retaining the remaining coins in what remains of the wrapped roll.

SUMMARY OF THE INVENTION

It is a primary object of this invention to provide a simple device for slitting open the rolled-rim end of a wrapped coin roll wrapper. It is another object of this invention to provide a coin roll tubular wrapper with means to easily open the coin roll after the rolled-rim edge has been slit. These and other objects and advantages of the invention will become apparent from the following detailed discussion of the invention.

DETAILED DESCRIPTION OF THE INVENTION

Figure 1:
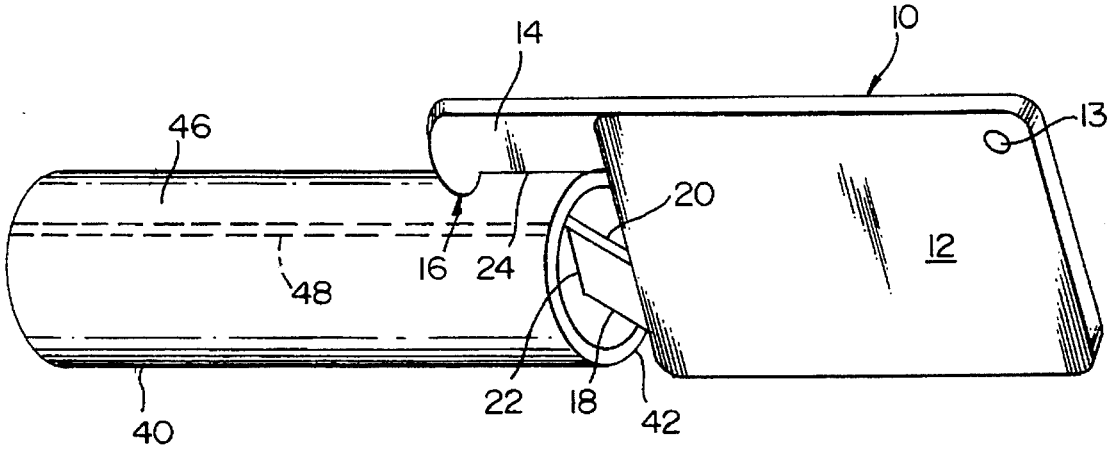
FIG. 1 is a view in perspective of the coin roll slitting device of this invention positioned against a roll of coins in preparation for slitting the rolled-rim of the coin roll wrapper.

The coin roll slitting device 10 comprises a main body section 12 of a size that is convenient to be grasped by a user's thumb and fingers. The device 10 also includes an arm section 14 that is provided with a downwardly extending end protrusion 16, and a slitting blade 18. The slitting blade 18 is mounted within body section 12 in a way such that its sharpened cutting edge 20 is inclined forwardly and upwardly to end at a tip 19 that underlies arm section 14 as shown. The arm section 14 extends forwardly away from body section 12 a sufficient distance that end protrusion 16 is located forwardly of blade tip 19. The relationship between blade tip 19 and the lowermost point of end protrusion 16 is such that blade tip 19 is lower in elevation than end protrusion 16. There is a space between the blade tip 19 and the underside 24 of arm section 14 that is sufficient to enable the rolled rim 44 of a coin roll 40 to be inserted therein to bring the blade 18 up against the exposed face 44 of the end coin in the coin roll.

The forward edge 22 of blade 18 is vertical so that it may be positioned flat against the exposed face 44 of the end coin in the coin roll wrapper 40. When the coin roll wrapper 40 is thus positioned, the arm section 14 will extend over the end of the coin roll so that end protrusion 16 will bear against the outer surface of the coin roll some distance away from the end of the roll. These relative positions are shown in FIG. 1. As thus positioned, when the device 10 is rotated upward about the end protrusion 16, the blade tip 19 will swing upward in an arc, with the end protrusion serving as the fulcrum point, from the solid line position shown in FIG. 2 to the dotted line position shown in FIG. 2. As a result of being pivoted upwardly, the blade tip 19 will pierce the rolled rim 44 of the coin roll wrapper 40, and the blade cutting edge 20 will cut through the rolled rim 44. The severed end of the annulus of the rolled rim may then be grasped and pulled apart to tear the wrapping open to expose as many coins as desired.

Figure 2:
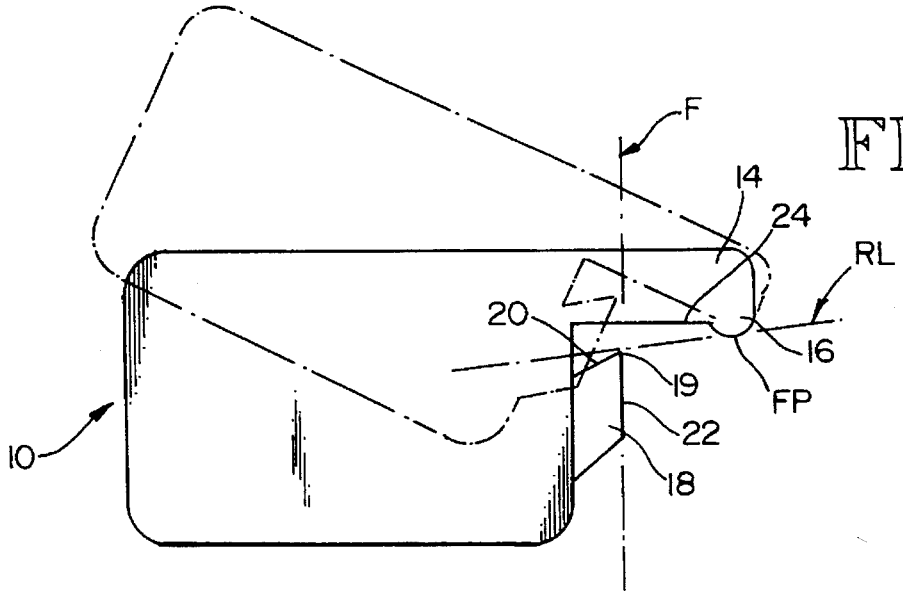
FIG. 2 is a side view in elevation of the coin roll slitting device of this invention, illustrating by solid line the position of the device prior to opening a coin roll rolled-rim, and illustrating by dotted line the position of the device after a coin roll rolled-rim has been slit open.

Because of the relationship between the blade 18, the arm section 14 and its end protrusion 16, with the blade tip 19 being at a lower elevation than the end protrusion 16, a radius line RL extending between the tip 19 and the bottom of protrusion 16 is oriented downwardly from protrusion 19 to tip 19 as shown in FIG. 2. Thus, radius line RL is not perpendicular to the exposed face of the end coin of the roll, the plane of the exposed coin face being represented by line F. Consequently, when the device 10 is pivoted upward about the fulcrum point FP of protrusion 16, the blade tip 19 will be rotated upwardly, with respect to the face line F, slightly outwardly as it pierces and severs the rolled rim 42. As the blade tip 19 is moved through this arc, it will just miss the rim of the exposed coin face 44, and thereby will avoid catching on the coin rim as the rolled rim is severed. This feature will avoid dulling the blade tip 19 and will avoid the severing operation from becoming jammed. The distance between the fulcrum point FP and the blade tip 19 must not be so large that the arc of tip travel is insufficient to enable the tip 19 to miss the coin rim during the severing operation. A preferred embodiment of the slitting device 10 is about ⅛ inches thick and has a body 12 that is about 2 inches long and about 1⅜ inches high; an arm 14 that is about ⅞ inches long and about 5/16 inches high; an end protrusion 16 that depends about 1/16 inches from the bottom side 24 of arm 14, a blade 18 having a cutting edge 20 that extends upwardly at about a 45° angle with its tip 19 spaced about ¼ inches forward of the front end of body 12 and about ⅛ inches below the bottom edge 24 of arm 14. The device 10 is preferably fabricated from a plastic material, blade 18 is preferably fabricated from a thin piece of steel, and blade 18 is preferably molded into the body 12 and protrudes therefrom as shown in the Figures. One corner of the body 12 may be provided with a transverse hole 13 so that a key chain or cord could be attached to the body; thereby affording a means for hanging the device on a hook or the like in an accessible location.

Figure 3:
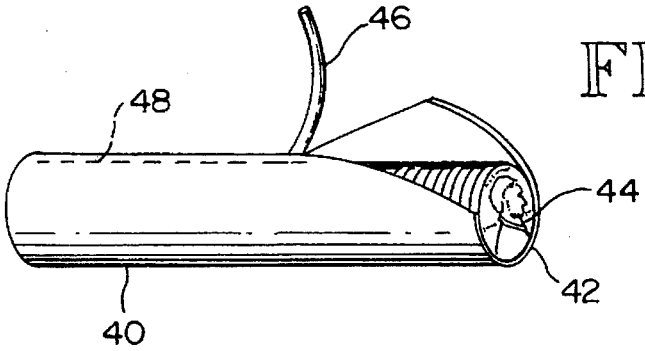
FIG. 3 is a view in perspective of a coin roll that has had its rolled-rim slit open, illustrating the tear-open means embodied in a preferred coin roll wrapper of this invention.

The coin roll wrapper 40 may be provided with a longitudinal strip 46 along a seam 48 as shown in FIGS. 1 and 3. This strip 46 may be provided by a cord or thread embedded in or on the material from which the wrapper itself is fabricated. Once the rolled rim 44 is severed as heretofore described, especially if it is severed where the strip 46 is located, the end of the strip 46 could be grasped and pulled away from the coin roll to tear the roll open along the seam 48 as shown in FIG. 3. In this configuration, the strip 46 would be applied to the seam 48 before the coins were wrapped and before the roll ends were rolled into rolled rims. The strip 46 would extend along the length of the wrapper material so that it would either be included within the rolled rim or would terminate so close to the rolled rims that the end of the strip would be exposed by the roll rim severing operation. Thus the seam 48 would extend at least along the full length of the wrapper 40 between the rolled rim ends, and could extend along the full length of the wrapper tube before the ends are crimped.

While the preferred embodiment of the invention has been described herein, variations in the design may be made. The scope of the invention, therefore, is only to be limited by the claims appended hereto.

The embodiments of the invention in which an exclusive property is claimed are defined as follows:

What is claimed is:

1. A coin roll slitting device which comprises a main body section to be grasped by a user's thumb and fingers, a slitting blade means provided with an exposed sharpened cutting edge and a blade tip, an arm section means extended outward from said body section and having a downwardly extending end protrusion for providing a fulcrum point so that when said slitting device is rotated about said end protrusion said blade tip can pierce the rolled or crimped rim of a coin roll whereby said blade cutting edge will cut through the rolled or crimped rim;

said slitting blade being mounted by said body section in a way such that its sharpened cutting edge is inclined forwardly and upwardly to end at a tip that underlies said arm section means and said arm section means extending forwardly away from said body section a sufficient distance that its end protrusion is located forwardly of said blade tip so that there is a space between said blade tip and the underside of said arm section means that is sufficient to enable a rolled or crimped rim of a coin roll to be inserted in said space to bring said blade up against an exposed face of an end coin in the coin roll, whereby, when a coin roll is positioned for slitting, said arm section means will extend over the end of the coin roll so that said end protrusion will bear against the outer surface of the coin roll some distance away from the end of the roll; and whereby, when said slitting device is rotated upward about said the end protrusion, said blade tip will swing upward in an arc, with the end protrusion serving as the fulcrum point, said blade tip will pierce the rolled or crimped rim of the coin roll, and said blade cutting edge will cut through the rolled or crimped rim.

2. The slitting device according to claim 1 wherein the relationship between said blade tip and the lowermost point of said end protrusion is such that said blade tip is lower in elevation than said end protrusion, whereby, when said slitting device is pivoted upward about a fulcrum point of said end protrusion, said blade tip will be rotated upwardly and slightly outwardly as it pierces and severs the rolled or crimped rim to miss the rim of the exposed coin face, and thereby avoid catching on the coin rim as the rolled or crimped rim is severed.

3. The slitting device of claim 2 wherein the forward edge of said blade is substantially perpendicular to said arm section means so that it may be positioned flat against the exposed face of the end coin in a coin roll.

4. The slitting device of claim 1 wherein said body section and said arm section means are fabricated from a plastic material such that these sections are thin and generally rectangular, and wherein said blade is fabricated from a thin piece of steel and molded into said body to protrude therefrom as described.

5. The slitting device according to claim 4 wherein the relationship between said blade tip and the lowermost point of said end protrusion is such that said blade tip is lower in elevation than said end protrusion, whereby, when said slitting device is pivoted upward about a fulcrum point of said end protrusion, said blade tip will be rotated upwardly and slightly outwardly as it pierces and severs the rolled or crimped rim to miss the rim of the exposed coin face, and thereby avoid catching on the coin rim as the rolled or crimped rim is severed.

6. The slitting device of claim 5 wherein the forward edge of said blade is substantial perpendicular to said arm section means so that it may be positioned flat against the exposed face of the end coin in a coin roll.

7. A method of opening a coin roll comprising: providing a coin roll with a wrapper enclosing a series of coins and crimped or rolled at the ends thereof the hold the coins securely, said wrapper having a tear seam extending the length or the wrapped coin roll at least between the rolled or crimped ends, and said wrapper having a tear strip fastened to said wrapper along said tear seam; slitting one of the coin roll rolled or crimped ends adjacent to said tear seam to expose said tear strip; and pulling on said tear strip to open the coin roll and expose the coins therein.

8. The method of claim 7 wherein said coin roll end is slitted by contacting an exposed face of an end coin of said coin roll by a pointed blade, rotating said blade upward in an arc to first pierce the rolled or crimped rim of the coin roll, and then cut through the rolled or crimped rim to expose said tear strip.

* * * * *